US007834309B2

(12) United States Patent
Anderson et al.

(10) Patent No.: US 7,834,309 B2
(45) Date of Patent: Nov. 16, 2010

(54) OFFSET OPTICAL SECURITY SENSOR FOR A DOOR

(75) Inventors: David Anderson, Rochester, NY (US); William DiPoala, Fairport, NY (US); Jeffrey Swan, Rochester, NY (US)

(73) Assignees: Robert Bosch Security Systems, Inc., Fairport, NY (US); Robert Bosch GmbH, Stuttgart (DE)

( * ) Notice: Subject to any disclaimer, the term of this patent is extended or adjusted under 35 U.S.C. 154(b) by 0 days.

(21) Appl. No.: 12/349,782

(22) Filed: Jan. 7, 2009

(65) Prior Publication Data

US 2009/0114801 A1 May 7, 2009

Related U.S. Application Data

(63) Continuation of application No. 11/782,676, filed on Jul. 25, 2007, now Pat. No. 7,491,926.

(51) Int. Cl.
*G06M 7/00* (2006.01)

(52) U.S. Cl. ..... 250/221; 340/541; 340/545.1; 340/545.3

(58) Field of Classification Search ..... 250/221; 340/541, 545.1, 545.3
See application file for complete search history.

(56) References Cited

U.S. PATENT DOCUMENTS 5,912,619 A 6/1999 Vogt
2004/0239952 A1 * 12/2004 Mueller ..... 356/614

FOREIGN PATENT DOCUMENTS

GB 2013332 A 1/1979

* cited by examiner

*Primary Examiner*—Georgia Y Epps
*Assistant Examiner*—Kevin Wyatt
(74) *Attorney, Agent, or Firm*—Keith J. Swedo, Esquire; Taft Stettinius Hollister LLP

(57) ABSTRACT

A security sensor apparatus senses movement of an object. The sensor apparatus includes an electronics arrangement having an optical emitter and an optical receiver. The optical receiver has an axis of reception. The optical emitter emits a first beam along an axis of emission in an emission direction. The axis of emission diverges in the emission direction from the axis of reception at an angle of at least two degrees. The electronics arrangement is mounted in association a first surface of the object or a second surface of a structure disposed in opposition to the first surface. A reflector arrangement includes at least one reflective surface and is mounted in association with the other of the first surface and the second surface. The at least one reflective surface receives at least a portion of the first beam and produces a second beam directed at and received by the optical receiver.

20 Claims, 13 Drawing Sheets

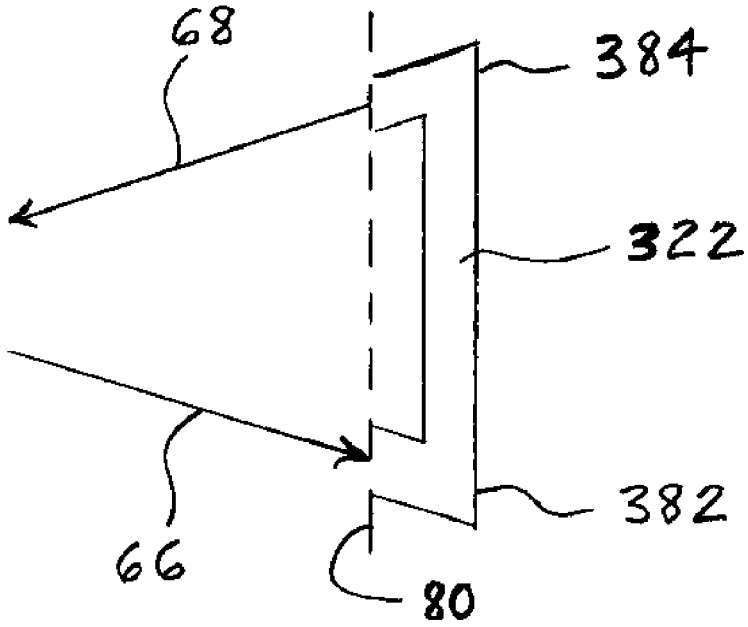
FIG. 12a
FIG. 12b
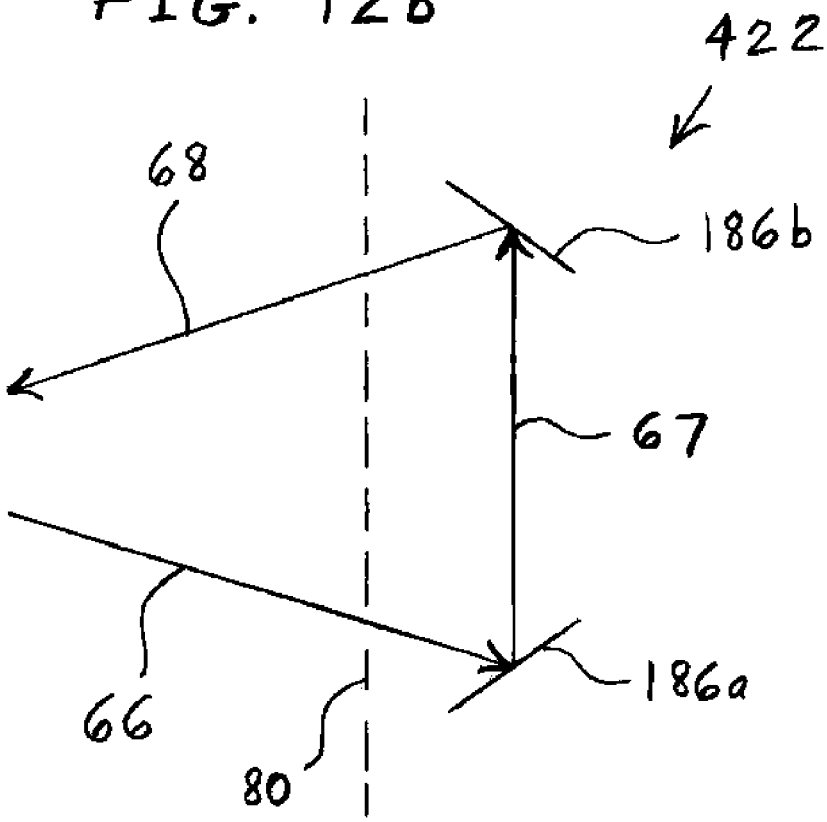

OFFSET OPTICAL SECURITY SENSOR FOR A DOOR

CROSS-REFERENCE TO RELATED APPLICATIONS/INCORPORATION BY REFERENCE

This application is a continuation of U.S. patent application Ser. No. 11/782,676 entitled "OFFSET OPTICAL SECURITY SENSOR FOR A DOOR", filed Jul. 25, 2007, the complete subject matter of which is hereby incorporated herein by reference, in its entirety.

BACKGROUND OF THE INVENTION

1. Field of the Invention

The present invention relates to surveillance system sensors, and, more particularly, to surveillance system sensors for detecting the opening of a door or window.

2. Description of the Related Art

Surveillance systems, also known as security systems, are known to include door sensors for monitoring the opening and closing of a door. Door sensors are known to be in the form of a pushbutton that is held in a depressed state by the door when the door is in a closed position. When opening, the door moves away from the pushbutton, thereby releasing the pushbutton from the depressed state. A controller monitors the state of the pushbutton, and may issue an alarm signal if the door is opened without authorization. A problem with this type of sensor is that an intruder can defeat it by inserting a thin object, such as a piece of sheet metal, between the door and the pushbutton such that the object holds the pushbutton in a depressed state when the door is opened. Thus, the controller cannot detect that the door has been opened.

Another type of door sensor is the magnetic reed switch type that includes a reed switch sensor mounted on the door frame. The sensor detects and monitors the presence of a magnet that is mounted on the door at a location that is adjacent to the sensor when the door is in the closed position. Thus, the magnet may be detected by the sensor only when the door is closed. A problem with this type of sensor is that it too may be defeated by an intruder. For example, the intruder may attach another magnet adjacent to the reed switch sensor before opening the door such that the sensor's detection of the presence of a magnet is uninterrupted. Here too, the sensor, and a controller connected to the sensor, cannot detect that the door has been opened.

What is needed in the art is a door/window sensor that cannot be easily defeated by an intruder and that can be incorporated into a security system.

SUMMARY OF THE INVENTION

The present invention provides a door sensor having a first part that may be mounted on a door frame or on a door, and that includes an optical emitter and an optical receiver. A second part of the door sensor may be mounted on the other one of the door frame and the door, and includes a reflector arrangement that reflects an optical beam from the emitter back to the receiver. The reflected beam received by the receiver may be laterally offset by an inch or more from the beam as provided by the emitter.

The invention comprises, in one form thereof, a security sensor apparatus for sensing movement of an object. The sensor apparatus includes an electronics arrangement having an optical emitter and an optical receiver. The optical receiver has an axis of reception. The optical emitter emits a first beam along an axis of emission in an emission direction. The axis of emission diverges in the emission direction from the axis of reception at an angle of at least two degrees. The electronics arrangement is mounted in association a first surface of the object or a second surface of a structure disposed in opposition to the first surface. A reflector arrangement includes at least one reflective surface and is mounted in association with the other of the first surface and the second surface. The at least one reflective surface receives at least a portion of the first beam and produces a second beam directed at and received by the optical receiver The invention comprises, in another form thereof, a security sensor apparatus for sensing movement of an object. An electronics arrangement includes an optical emitter and an optical receiver. The optical emitter emits a first beam. The electronics arrangement is mounted in a first surface of the object or a second surface of a structure disposed in opposition to the first surface. A reflector arrangement includes at least one reflective surface. The reflector arrangement is mounted in the other of the first surface and the second surface. The at least one reflective surface receives the first beam and produces a second beam directed at the optical receiver. The second beam is substantially parallel to and offset from the first beam by at least one inch.

The invention comprises, in yet another form thereof, a method of determining whether an object is in a closed position. At least one reflective surface is mounted along a perimeter of the object. An optical receiver having an axis of reception is provided. An optical emitter having an axis of emission is provided. A first optical beam is transmitted along the axis of emission in an emission direction. The axis of emission diverges in the emission direction from the axis of reception at an angle of at least two degrees. The at least one reflective surface is used to receive at least a portion of the first optical beam and produce therefrom a second optical beam. The optical receiver is used to receive the second optical beam while the object is in the closed position. It is determined whether the object is in the closed position based upon an evaluation of the received second optical beam.

An advantage of the present invention is that it is difficult for a would-be intruder to defeat. For example, because the final reflected beam may be offset by an inch or more from the beam as originally emitted, it would be difficult for an intruder to insert a single planar mirror or sheet of paper between the door and the door frame to thereby intercept the emitted beam and reflect it toward the optical receiver. Further, an emission cone of the optical emitter may be angled away from the reception cone of the optical receiver, thereby increasing the difficulty for the intruder of reflecting the emitted beam back toward the receiver.

Another advantage is that it is difficult for a would-be intruder to defeat by inserting an optical emitter between the door and the door frame to thereby emit an optical beam directly at the optical receiver. The emitted optical beam may carry a specific signal, and the electronic module may detect tampering by ascertaining that the beam received by the optical receiver does not carry a signal that has a certain relationship to the signal carried by the originally emitted beam. The signal may vary from electronic module to electronic module, or may vary with time, thereby making it difficult for a would-be intruder to reproduce the signal.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein:

FIG. 12*a* is a schematic view of another embodiment of the reflector arrangement of the sensor apparatus of FIG. 2.

FIG. 12*b* is a schematic view of yet another embodiment of the reflector arrangement of the sensor apparatus of FIG. 2.

Figure 1:
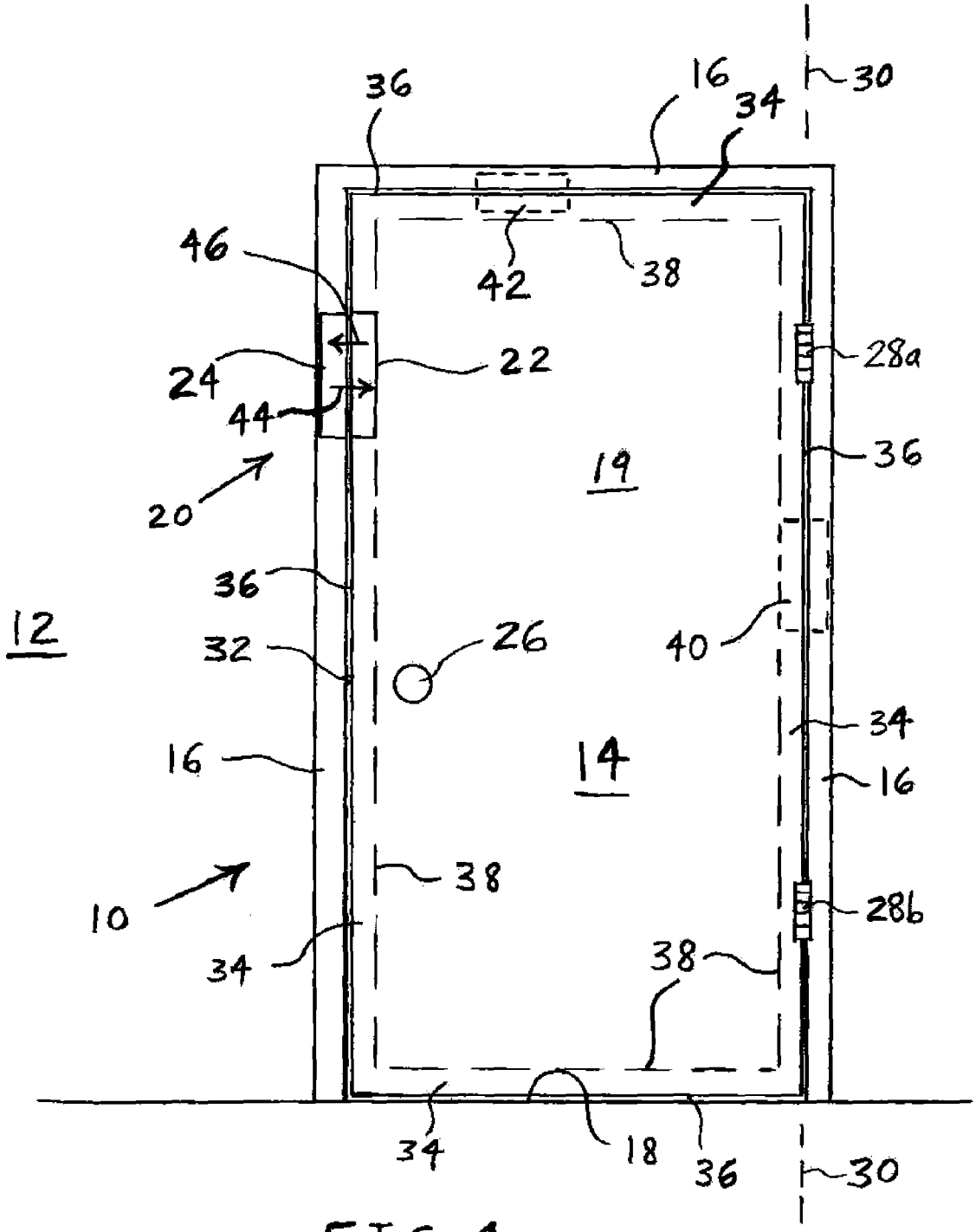
FIG. 1 is a plan view of one embodiment of a door assembly including an optical security sensor apparatus of the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Referring now to the drawings and particularly to FIG. 1, there is shown one embodiment of a security assembly, in particular a door assembly 10, of the present invention for incorporation into a structure 12 such as a building, or, more particularly, a wall of a building. Door assembly 10 includes a movable building structure in the form of a door 14, which is surrounded by portions of structure 12, such as a door frame 16 and a floor surface 18. Door frame 16 and a floor surface 18 define a building opening 19 in the form of a doorway that door 14 covers when door 14 is in a closed position and that door 14 uncovers when door 14 is in an open position. An optical security sensor apparatus 20 is mounted partially within door 14 and partially within door frame 16. Optical security sensor apparatus 20 includes a reflector arrangement 22 and an electronics arrangement in the form of a module 24. Reflector arrangement 22 and module 24 may be mounted in opposing locations within door 14 and door frame 16, respectively.

Door 14 may be opened by manually grasping knob 26 and rotating door 14 about hinges 28*a*, 28*b*, i.e., about an axis 30 defined by hinges 28, as is well known. If door 14 is locked, i.e., if a latch 32 of door 14 is locked in a coupled state with frame 16, an intruder may nevertheless open door 14 by breaking hinges 28 and/or latch 32 away from frame 16, thereby allowing door 14 to be moved away from frame 16, as is also well known.

Reflector arrangement 22 may be mounted in a surface of door 14 at a location that is along a perimeter 34 of door 14. Perimeter 34 may be defined as an outer section of door 14 that is between outer edges 36 of door 14 and locations indicated generally by dashed line 38. Reflector arrangement 22 is shown mounted in a surface of perimeter 34 that is disposed opposite from hinges 28. However, reflector arrangement 22 could alternatively be mounted in a surface of perimeter 34 that is adjacent to hinges 28, as indicated at 40. Moreover, reflector arrangement 22 could be mounted not in a jamb, but rather in a surface of an upper portion of perimeter 34, as indicated at 42.

Regardless of in which location in the surface of perimeter 34 reflector arrangement 22 is mounted, electronic module 24 may be mounted in a surface of door frame 16 at a location that opposes the mounting location of reflector arrangement 22. Particularly, the relative mounting locations of reflector arrangement 22 and electronic module 24 may be such that an optical beam emitted by electronic module 24, as indicated by arrow 44, may be reflected back to an optical receiver of electronic module 24, as indicated by arrow 46. Reflector arrangement 22 may receive the emitted optical beam and reflect the beam a plurality of times such that the final beam directed back to the optical receiver is offset by an inch or more from the originally emitted beam, as indicated generally by the spacing of arrows 44, 46, and as described in more detail hereinbelow.

Figure 2:
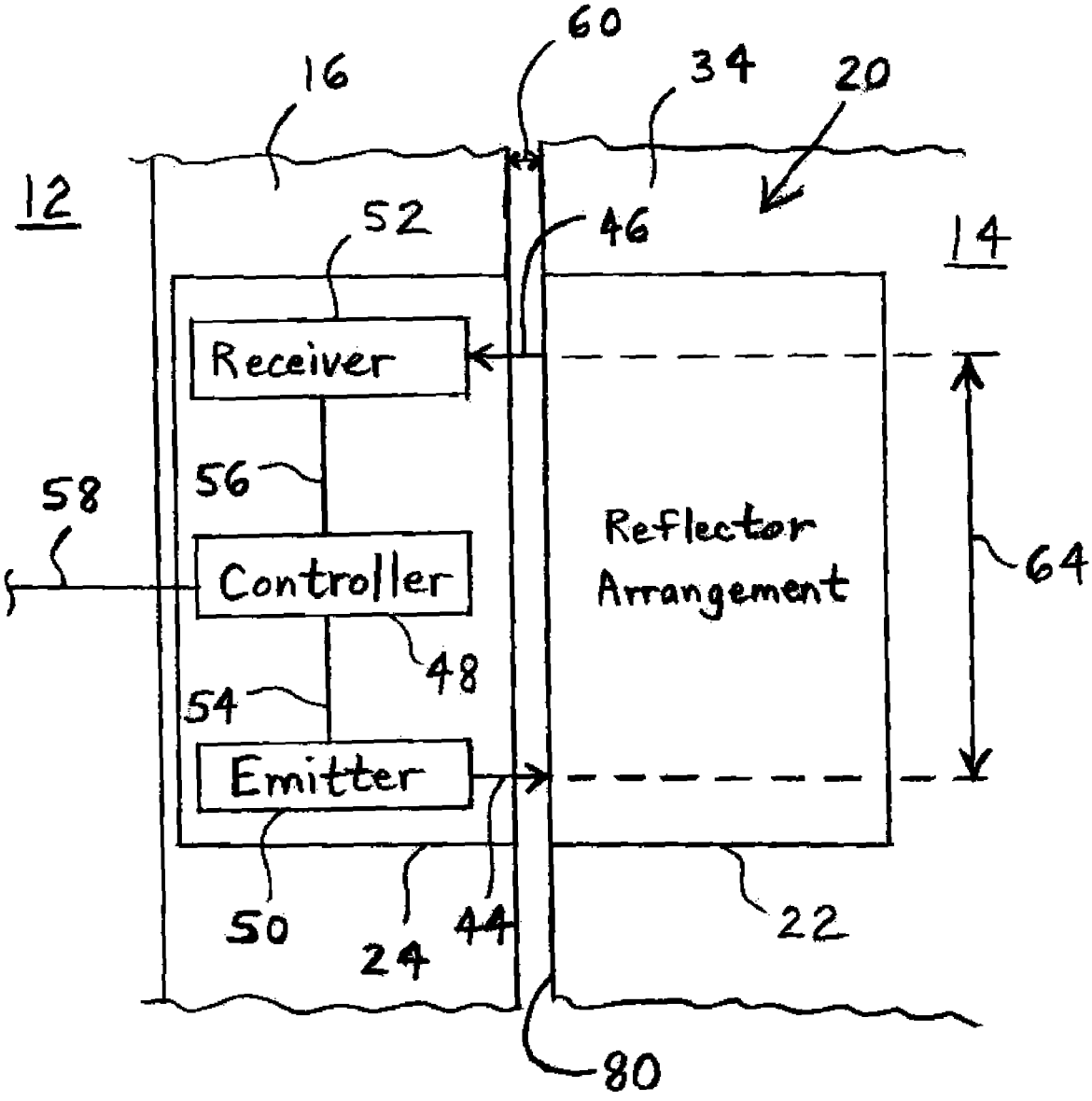
FIG. 2 is a block diagram of the sensor apparatus of FIG. 1.

As shown in FIG. 2, electronic module 24 may include a controller 48 that may be electrically connected to both optical emitter 50 and optical receiver 52, such as through lines 54, 56, respectively. Through line 58, controller 48 may be electrically connected to a control panel (not shown) or some other centralized device that is capable of causing some type of alarm signal or tamper signal to be issued in response to controller 48 determining that door 14 has been opened without authorization. A determination that door 14 has been opened may be made by controller 48 as a result of sensing that receiver 52 is not receiving an optical beam that corresponds to or that is related to the optical beam that is being emitted by emitter 50.

Emitter 50 may be in the form of a light-emitting diode (LED) that emits optical energy in the infrared range. In one particular embodiment emitter 50 produces optical energy having a wavelength of about 940 nanometers. Receiver 52 may be a photodiode or any other type of optical receiver that is capable of detecting optical energy of the frequency range emitted by emitter 50.

As is best illustrated in FIG. 2, an advantage of the present invention is that it would be difficult to defeat sensor apparatus 20 by inserting a single planar mirror or a sheet of paper into a gap 60 between door 14 and door frame 16. The difficulty of defeating sensor apparatus 20 in this way is at least partially attributable to an offset 64 of at least one inch between originally emitted beam 44 and finally reflected beam 46, which makes it difficult for someone to replicate reflected beam 46 by inserting a single mirror or a sheet of paper into gap 60 at an orientation that is substantially perpendicular to emitted beam 44.

In order to illustrate why offset 64 makes defeating sensor apparatus 20 difficult, assume that offset 64 is reduced to a degree that it is substantially eliminated. In these circumstances, the angle at which emitted beam 44 would need to be reflected to reach receiver 52 in a single reflection would approach zero. Thus, it would become more feasible to defeat the sensor apparatus by inserting into gap 60 a sheet of paper or a single planar mirror that is narrower than gap 60, and by then orienting the mirror or paper slightly non-perpendicular to emitted beam 44 to thereby reflect beam 44 such that it may be received by receiver 52. However, due to an offset 64 of at least one inch, it may be practically impossible to insert paper or a small mirror into gap 60 and reflect emitted beam 44 such that it may be received by receiver 52.

Because of the offset 64 of at least one inch between beams 44, 46, it may not be necessary for emitted beam 44 to be polarized. That is, even if beam 44 is not polarized, offset 64 may prevent diffusely emitted or scattered optical energy from emitter 50 from reaching receiver 52 without being reflected thereto by reflector arrangement 22.

Figure 3:
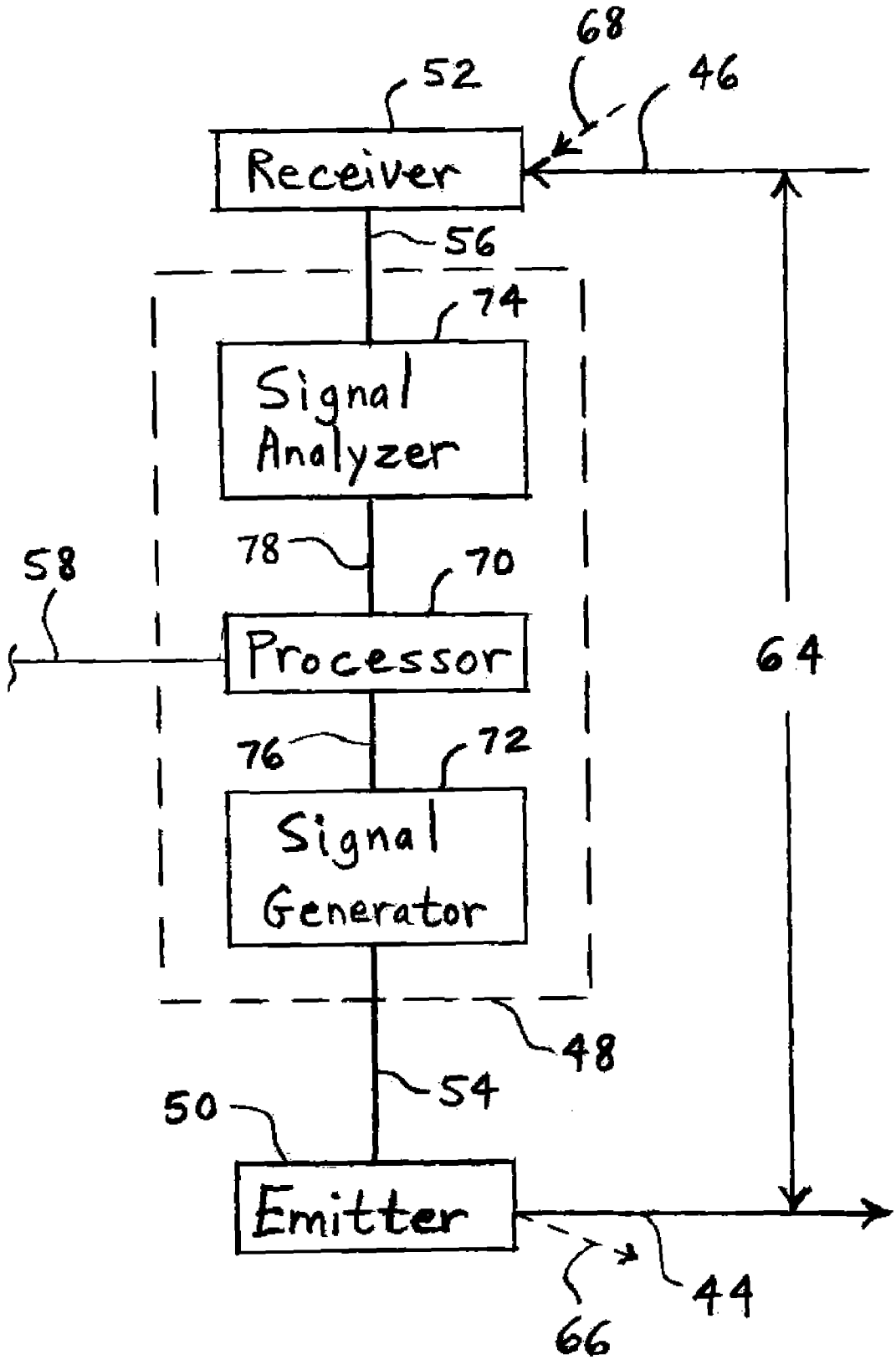
FIG. 3 is a block diagram of the electronics arrangement of the sensor apparatus of FIG. 2.

Although in one embodiment beams 44, 46 are substantially parallel, it is also possible within the scope of the invention for the emitted beam to diverge from the receiver such as at a direction indicated by dashed line 66 in FIG. 3. In addition, or alternatively, to the emitter producing a divergent beam such as at 66, the receiver may be configured to receive a finally reflected beam from a divergent direction, such as indicated by dashed line 68. Such embodiments are discussed in more detailed herein with regard to FIGS. 11 and 12. Divergent beams such as indicated at 66 and 68 may have the advantage of making the optical sensor apparatus still harder to defeat by use of paper or a mirror inserted into gap 60. That is, a divergent emitted beam 66 may be more difficult to reflect to the receiver than is emitted beam 44; and a divergent received beam 68 may be more difficult for a would-be intruder to produce than is beam 46.

One embodiment of controller 48 is shown in more detail in FIG. 3. Controller 48 may include a processor 70, such as a microprocessor, electrically connected to a signal generator 72 and to a signal analyzer 74 via respective lines 76, 78. Signal generator 72 may provide input to emitter 50 on line 54 specifying a unique identifying signal that is to be carried on emitted beam 44. As a result, reflected beam 46 may carry a substantially equivalent signal, or at least reflected beam 46 may carry a signal that has a certain relationship to the signal carried by beam 44. That is, the signal carried by beam 44 may undergo some transformation within reflector arrangement 22 before being carried by beam 46, but it may be a somewhat predictable transformation. For example, the signal carried by reflected beam 46 may be reduced in amplitude, and/or shifted in phase, as compared to the signal carried by emitted beam 44. Signal analyzer 74 may ascertain the characteristics of the signal carried by reflected beam 46 based upon communications that analyzer 74 receives from receiver 52.

Signal analyzer 74 and/or processor 70 may determine whether door 14 is in a closed position based upon an evaluation of the received signal carried by reflected beam 46. For example, signal analyzer 74 and/or processor 70 may compare the received signal carried by reflected beam 46 to the emitted signal carried by emitted beam 44. Signal analyzer 74 and/or processor 70 may thus determine, based upon a relationship between the received signal carried by reflected beam 46 and the emitted signal carried by emitted beam 44, whether reflected beam 46 is a product of emitted beam 44 and reflector arrangement 22. If it is determined that reflected beam 46 is a product of emitted beam 44 and reflector arrangement 22, then it can also be determined that reflector arrangement 22 and electronic module 24 are disposed in opposition to each other and that door 14 is in a closed position within door frame 16.

In order to prevent a would-be intruder from duplicating the reflected beam 46 and the signal carried thereby, the signal carried by emitted beam 44 may vary from electronic module to electronic module, or may vary with time, thereby making it difficult for the prospective intruder to determine what signal that processor 70 and/or signal analyzer 74 are expecting to receive at any point in time. It is further possible for emitted beam 44 to carry a signal having a security code that is embedded therein and that is randomly determined by processor 70 at any point in time. The would-be intruder would then need to ascertain and duplicate the security code in order to defeat the optical sensor apparatus.

In order to avoid interference from ambient light, such as from electric light bulbs, it is possible to oscillate emitted beam 44 at some particular frequency that gets passed on to reflected beam 46. Thus, this characteristic frequency may be used by processor 70 and/or signal analyzer 74 to distinguish reflected beam 46 from ambient light. Household current may be typically oscillated at about 60 Hz. In one embodiment, emitted beam 44 is oscillated at a frequency of about 1000 Hz in order that reflected beam 46 may be more easily distinguished from ambient light.

During use, after installation of optical security sensor apparatus 20, door 14 is moved to a closed position and sensor apparatus 20 is armed, such as by a user via a control panel (not shown). In the armed state, sensor apparatus 20 may continually monitor the status of door 14. The user may disarm sensor apparatus 20 by entering a security code into the control panel, for example, perhaps within a grace time period after door 14 is opened. In the disarmed state, sensor apparatus 20 may no longer monitor door 14, or may refrain from issuing an alarm signal or tamper signal if door 14 is opened.

In the armed state, if door 14 is opened, such as by an intruder, then receiver 52 will no longer be in position to receive reflected beam 46. A determination that door 14 has been opened may be made by controller 48 based upon reflected beam 46 not being received by receiver 52 during a time period in which emitted beam 44 is still being emitted. Controller 48 may issue an alarm signal in response to the determination that door 14 has been opened without authorization.

If controller 48 determines that the signal being carried by the optical beam that is received by receiver does not have the expected relationship to the signal that is being carried by emitted beam 44, then controller 48 may conclude that someone may be tampering with sensor apparatus 20. That is, then controller 48 may conclude that someone may be unsuccessfully trying to defeat sensor apparatus 20 by attempting to simulate the reflected beam and accompanying signal that controller 48 expects to receive, and is directing the simulated beam and signal at receiver 52. Controller 48 may then issue a tamper signal, which may be, for example, in the form of a beeping sound that indicates to the user that investigation or maintenance may be needed.

Figure 4:
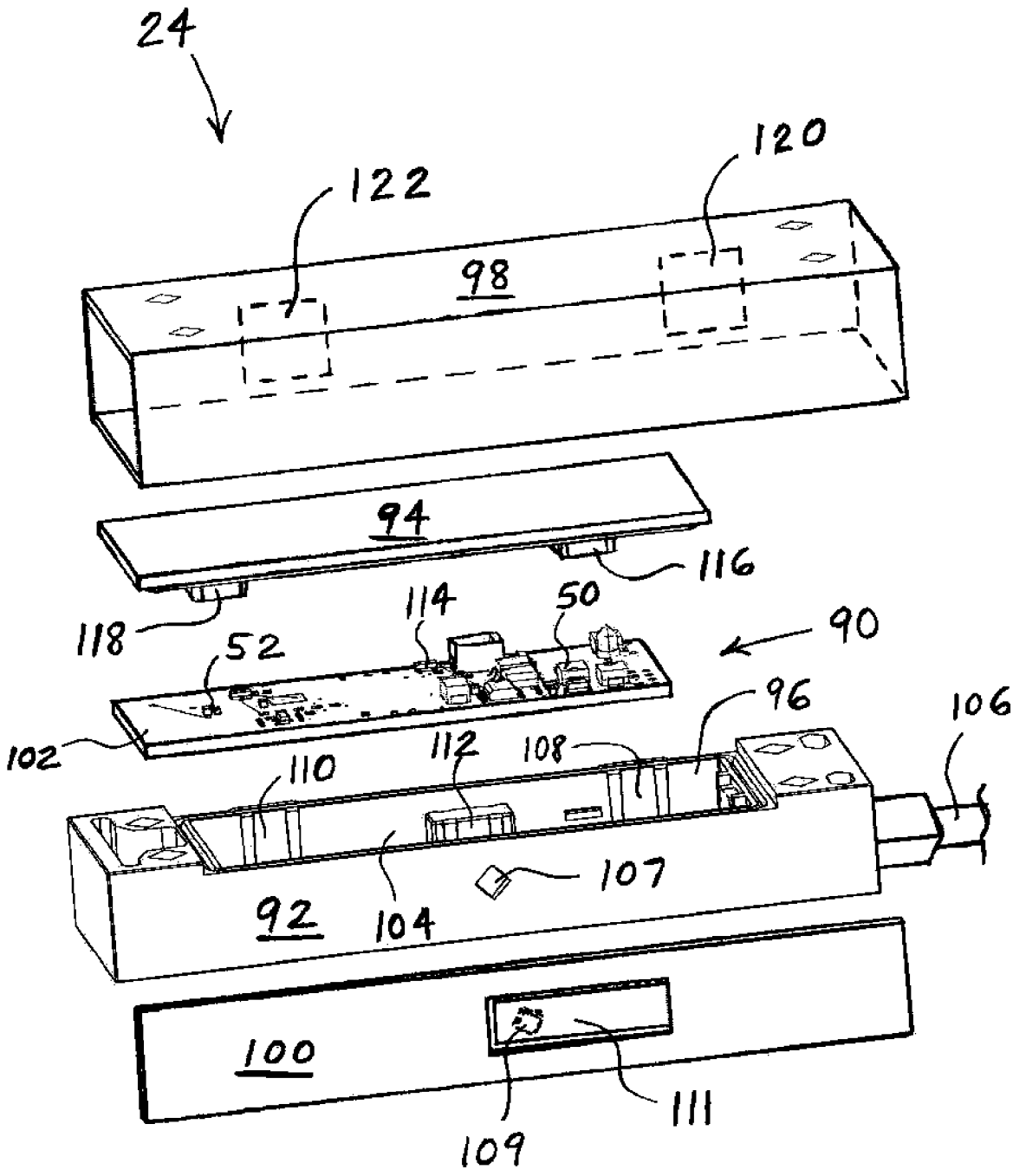
FIG. 4 is an exploded perspective view of one embodiment of the electronics arrangement of the sensor apparatus of FIG. 2.

One particular embodiment of electronic module 24 is illustrated in FIG. 4, including a circuit assembly 90 disposed within a housing 92. A cover 94 covers an opening 96 of housing 92. The combination of circuit assembly 90, housing 92 and cover 94 is received within a hollow, rectangular shell 98. A locking device 100 is also received within shell 98 to lock housing 92 in place within shell 98.

Circuit assembly 90 includes a circuit board 102 on which electronic components are mounted, including optical emitter 50, optical receiver 52, and controller 48. Circuit board 102 may be inserted through opening 96 of housing 92 and received in a recess 104 of housing 92.

Figure 5:
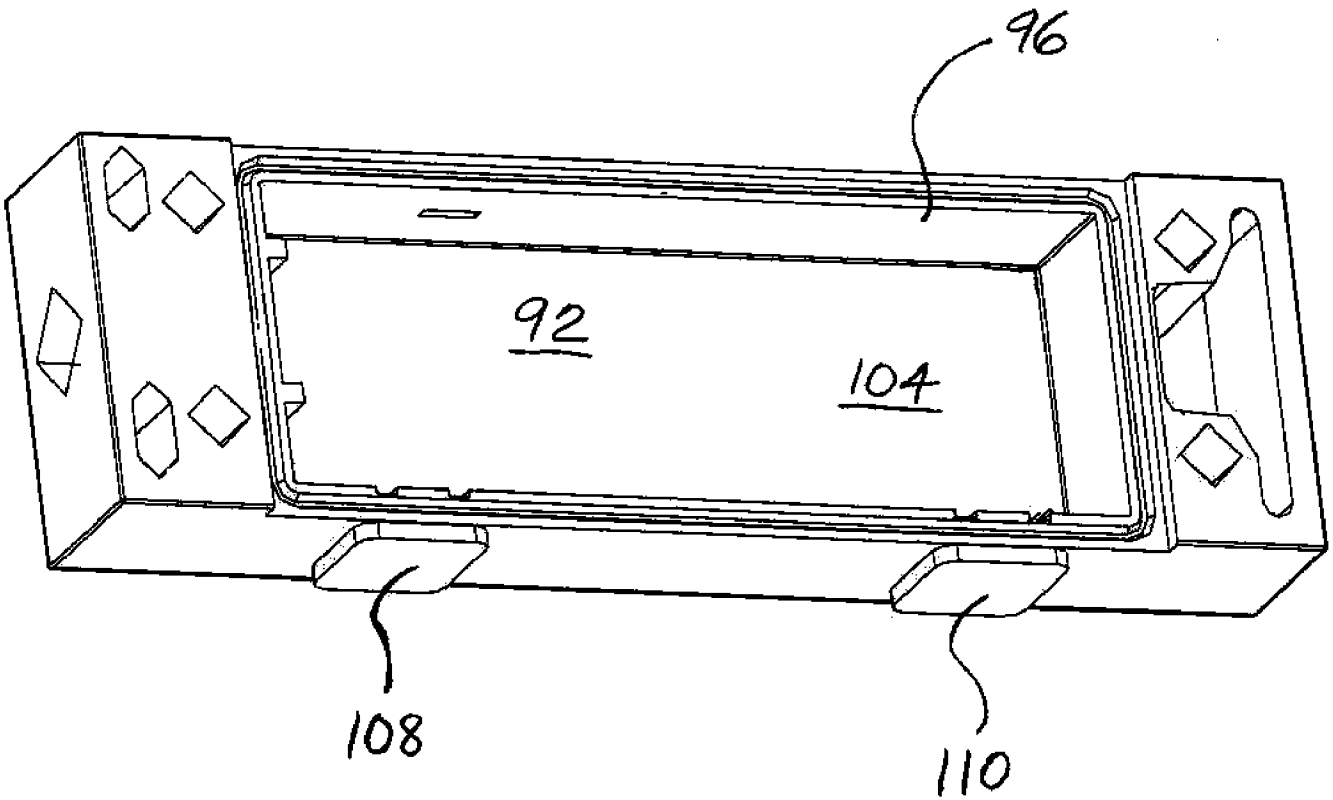
FIG. 5 is a perspective view of the housing of the electronics arrangement of the sensor apparatus of FIG. 2.

Housing 92, also shown in FIG. 5, is connected to an armored cable 106 that contains line 58 along with power lines (not shown). When positioned in recess 104, circuit board 102 may be electrically connected to line 58 via any of various known circuit board connection schemes.

Housing 92 includes a notch 107 for receiving a projection 109 on a leaf spring 111 of locking device 100. When projection 109 is received in notch 107, both housing 92 and locking device 100 are locked in shell 98, thereby preventing any tampering with circuit board assembly 90 without destroying electronic module 24.

Housing 92 may include windows 108, 110 that may be aligned with emitter 50 and receiver 52, respectively. In one embodiment, emitter 50 is in the form of an infrared light-emitting diode, and windows 108, 110 are formed of a material that blocks visible light and passes infrared light. In one particular embodiment, windows 108, 110 are formed of Lexan® polycarbonate material.

In one embodiment, housing 92 includes a magnetically transparent window 112 that may be aligned with a reed switch sensor 114 on circuit board 102. Through window 112, sensor 114 may sense the presence of a magnet on reflector arrangement 22, as discussed in more detail below.

Figure 6:
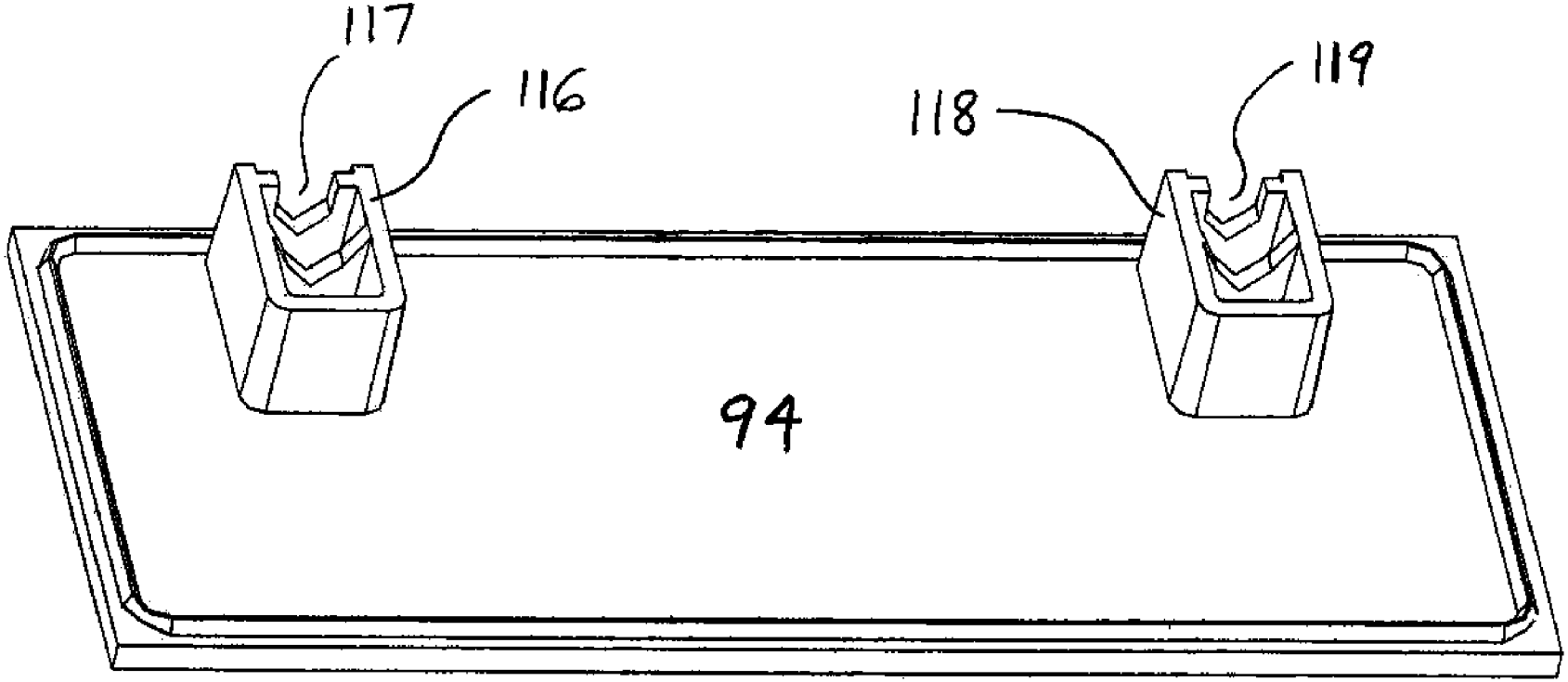
FIG. 6 is a perspective view of the housing cover of the electronics arrangement of the sensor apparatus of FIG. 2.

Housing cover 94, also shown in FIG. 6, may include an emitter shroud 116 for limiting the fanning range of optical energy from emitter 50. For example, shroud 116 may block optical emissions that are not directed through slot 117 and at window 108. Similarly, housing cover 94 may include a receiver shroud 118 for limiting the fanning range of optical energy that may be received by receiver 52. For example, shroud 118 may block optical emissions that are not received through window 110 and through slot 119.

Shell 98 includes through-holes 120, 122 that are aligned with windows 108, 110, respectively, when housing 92 is received in shell 98. Thus, through-hole 120 allows optical energy from window 108 to reach reflector arrangement 22, and through-hole 122 allows optical energy from reflector arrangement 22 to reach window 110. Shell 98 may be formed of a protective material such as extruded aluminum, for example.

Figure 7:
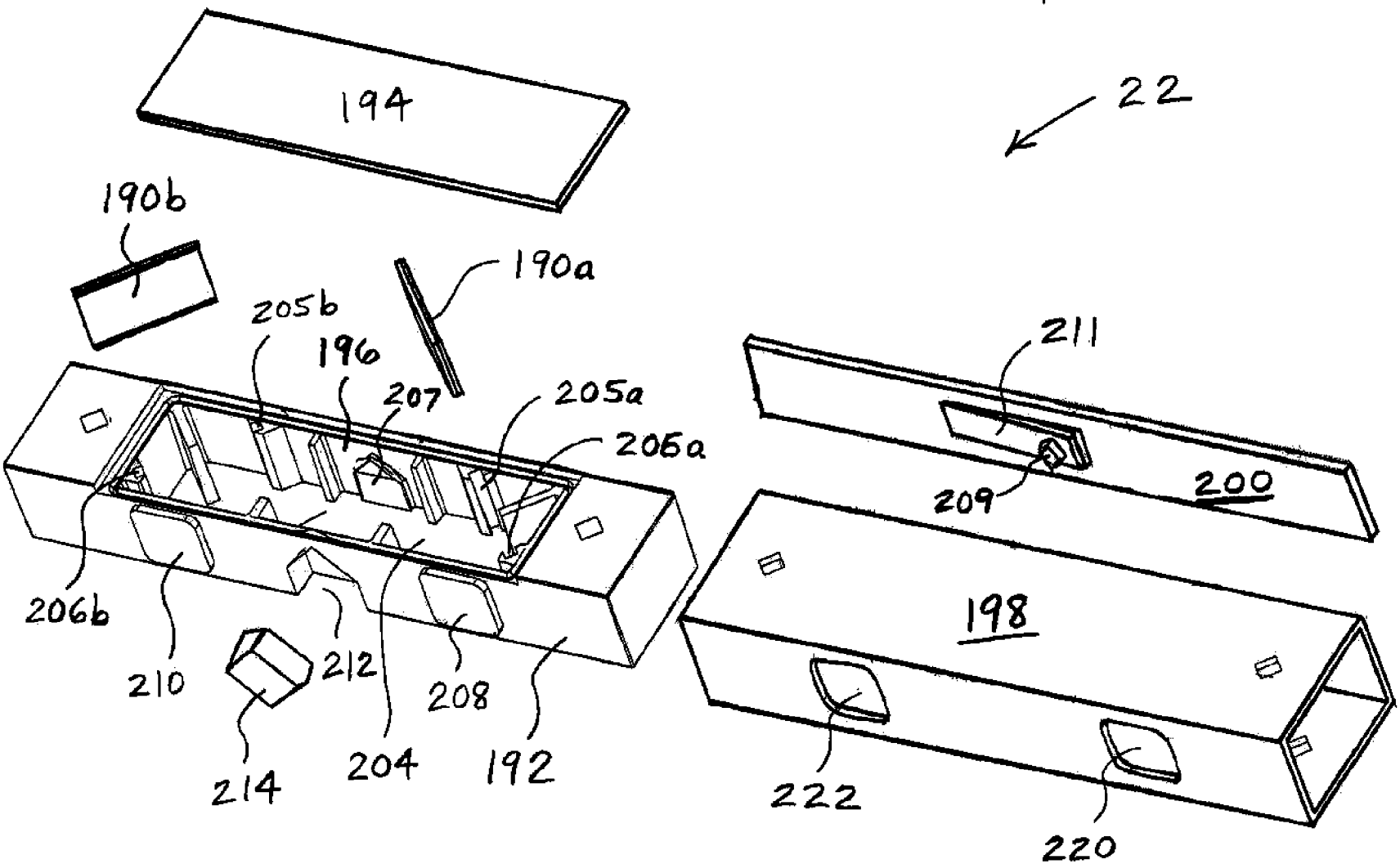
FIG. 7 is an exploded perspective view of one embodiment of the reflector arrangement of the sensor apparatus of FIG. 2.
Figure 8:
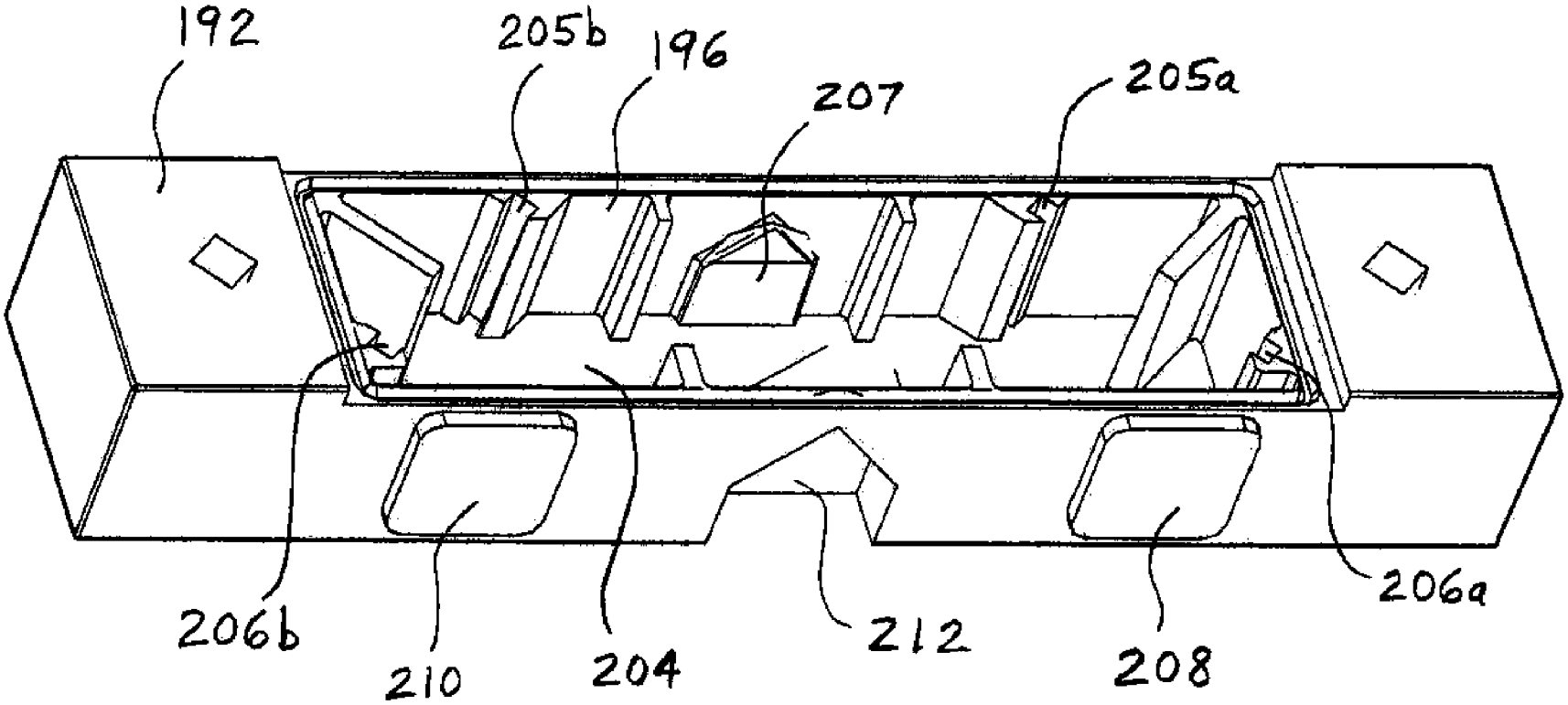
FIG. 8 is a perspective view of the housing of the reflector arrangement of the sensor apparatus of FIG. 2.

Illustrated in FIG. 7 is one particular embodiment of a reflector arrangement 22 that may be suitable for use with electronics module 24 of FIG. 4. Reflector arrangement 22 includes reflective surfaces in the form of a pair of mirrors 190*a*, 190*b* received in a housing 192, which is also shown in FIG. 8. A cover 194 covers an opening 196 of housing 192. The combination of mirrors 190, housing 192 and cover 194 is received within a hollow, rectangular shell 198. A locking device 200 is also received within shell 198 to lock housing 192 in place within shell 198.

Mirrors 190 may be inserted through opening 196 of housing 192 and received in a recess 204 of housing 192. More particularly, opposite edges of mirror 190*a* may be received in opposing slots 205*a*, 206*a* of housing 192. Similarly, opposite edges of mirror 190*b* may be received in opposing slots 205*b*, 206*b*. Mirrors 190 may be used to sequentially reflect an optical beam from emitter 50 a plurality of times, such as twice, such that some form of the optical beam is directed back to receiver 52.

Housing 192 includes a notch 207 for receiving a projection 209 on a leaf spring 211 of locking device 200. Only an inside view of notch 207 is provided in FIGS. 7 and 8, but an outside view of notch 207 may be similar to that of notch 107 in FIG. 4. When projection 209 is received in notch 207, both housing 192 and locking device 200 are locked in shell 198, thereby preventing any tampering with mirrors 190 without destroying reflector arrangement 22.

Housing 192 may include windows 208, 210 that may be aligned with windows 108, 110, respectively during installation of sensor apparatus 20. In one embodiment, emitter 50 is in the form of an infrared light-emitting diode, and windows 208, 210 are formed of a material that blocks visible light and passes infrared light. In one particular embodiment, windows 208, 210 are formed of Lexan® polycarbonate material.

In one embodiment, housing 192 includes a recess 212 that may or may not receive a magnet 214 therein. That is, magnet 214 may be provided in recess 212 on a random basis during assembly. Because any magnet 214 that may be provided in housing 192 is concealed by shell 198, it may be impossible for an intruder to be alerted to the possible presence of magnet 214. Even if the intruder is aware of the possible presence of magnet 214, he would not be able to visually determine whether or not magnet 214 is present in a particular sensor apparatus 20.

Recess 212 may be aligned with window 112 of housing 92 such that reed switch sensor 114 may sense whether or not magnet 214 is present in recess 212. Reed switch sensor 114 and magnet 214 provide sensor apparatus 20 with some sabotage protection. That is, if an intruder were to somehow reflect beam 44 back to receiver 52 without the use of reflector arrangement 22 (thereby enabling the intruder to open door 14 without being optically detected), he would also need to know (or correctly guess) whether or not magnet 214 is present in recess 212 in order to open door 14 without being magnetically detected. That is, the intruder would need to know, or correctly guess, whether to place a magnet next to reed switch sensor 114 before he opens door 14. If magnet 214 was not present in recess 212 and then a magnetic field is suddenly detected by reed switch sensor 114, controller 48 may detect tampering just as readily as controller 48 would detect the opening of door 14 if magnet 214 was present in recess 212 and then reed switch sensor 114 suddenly stopped detecting a magnetic field. Thus, magnet 214 and reed switch sensor 114 provide sensor apparatus 20 with some dual functionality, i.e., redundancy, to back up the operation of optical emitter 50 and optical receiver 52.

Shell 198 includes through-holes 220, 222 that are aligned with windows 208, 210, respectively, when housing 192 is received in shell 198. Thus, through-hole 220 allows optical energy from emitter 50 to reach window 208, and through-hole 222 allows reflected optical energy that passes through window 210 to reach receiver 52. Shell 198 may be formed of a protective material such as extruded aluminum, for example.

The present invention has been described herein as being applied to detecting the opening and closing of a hinged door that swings between an open position and a closed position. However, the present invention may be used to monitor any movable building structure that is movable between a closed position in which the movable building structure covers a building opening and an open position in which the movable building structure uncovers the building opening.

Figure 9:
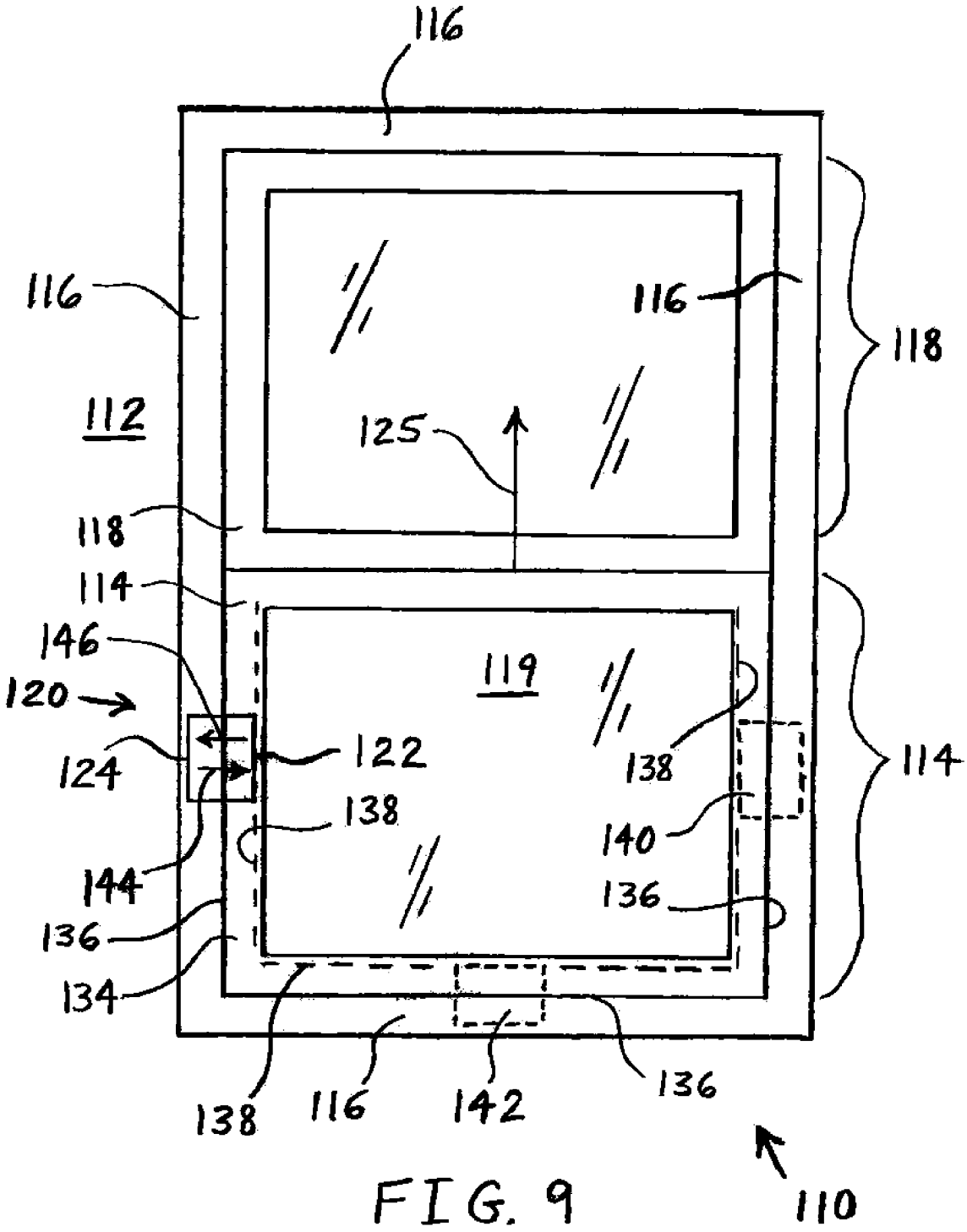
FIG. 9 is a plan view of one embodiment of a window assembly including an optical security sensor apparatus of the present invention.

In FIG. 9, there is shown another embodiment of a security assembly of the present invention in the form of a window assembly 110 for incorporation into a structure 112 such as a building, or, more particularly, a wall of a building. Window assembly 110 includes a movable building structure in the form of a movable window sash 114, which is surrounded by portions of structure 112, such as a wall, a window frame 116 and a fixed window sash 118. Window frame 116 and a fixed window sash 118 define a building opening 119 in the form of a window opening that sash 114 covers when sash 114 is in a closed position and that sash 114 uncovers when sash 114 is in an open position. An optical security sensor apparatus 120 is mounted partially within sash 114 and partially within window frame 116. More particularly, sensor apparatus 120 includes a reflector arrangement 122 and an electronics module 124 which may be mounted in opposing locations within sash 114 and window frame 116, respectively.

Sash 114 may be opened by manually grasping sash 114 and sliding sash 114 in an upward direction 125, as is well known. Imaginary planes defined by sashes 114, 118 may be parallel to each other and displaced from each other in a direction into the page of FIG. 9. To at least partially open sash 114, and thereby at least partially uncover opening 119, sash 114 may be slid in direction 125 in tracks (not shown) in frame 116 such that sash 114 at least partially overlaps sash 118 in a direction into the page of FIG. 9, as is also well known.

Reflector arrangement 122 may be mounted in a surface of sash 114 at a location that is along a perimeter 134 of sash 114. Perimeter 134 may be defined as an outer section of sash 114 that is between outer edges 136 of sash 114 and locations indicated generally by dashed line 138. Reflector arrangement 122 is shown mounted in a vertically-oriented surface of perimeter 134. However, reflector arrangement 122 could alternatively be mounted in the portion of the surface of perimeter 134 that is on the other end of sash 114, as indicated at 140. Moreover, reflector arrangement 122 could be mounted not in a vertically-oriented surface, but rather in a horizontally-oriented surface of perimeter 34 that is disposed opposite the window sill, as indicated at 142.

Regardless of in which location in the surface of perimeter 134 reflector arrangement 122 is mounted, electronic module 124 may be mounted in a surface of window frame 116 at a location that opposes the mounting location of reflector arrangement 122. Particularly, the relative mounting locations of reflector arrangement 122 and electronic module 124 may be such that an optical beam emitted by electronic module 124, as indicated by arrow 144, may be reflected back to an optical receiver of electronic module 124, as indicated by arrow 146. Reflector arrangement 122 may receive the emitted optical beam and reflect the beam a plurality of times such that the final beam directed back to the optical receiver is offset by an inch or more from the originally emitted beam, as indicated generally by the spacing of arrows 144, 146, and as described in more detail hereinabove.

Figure 10:
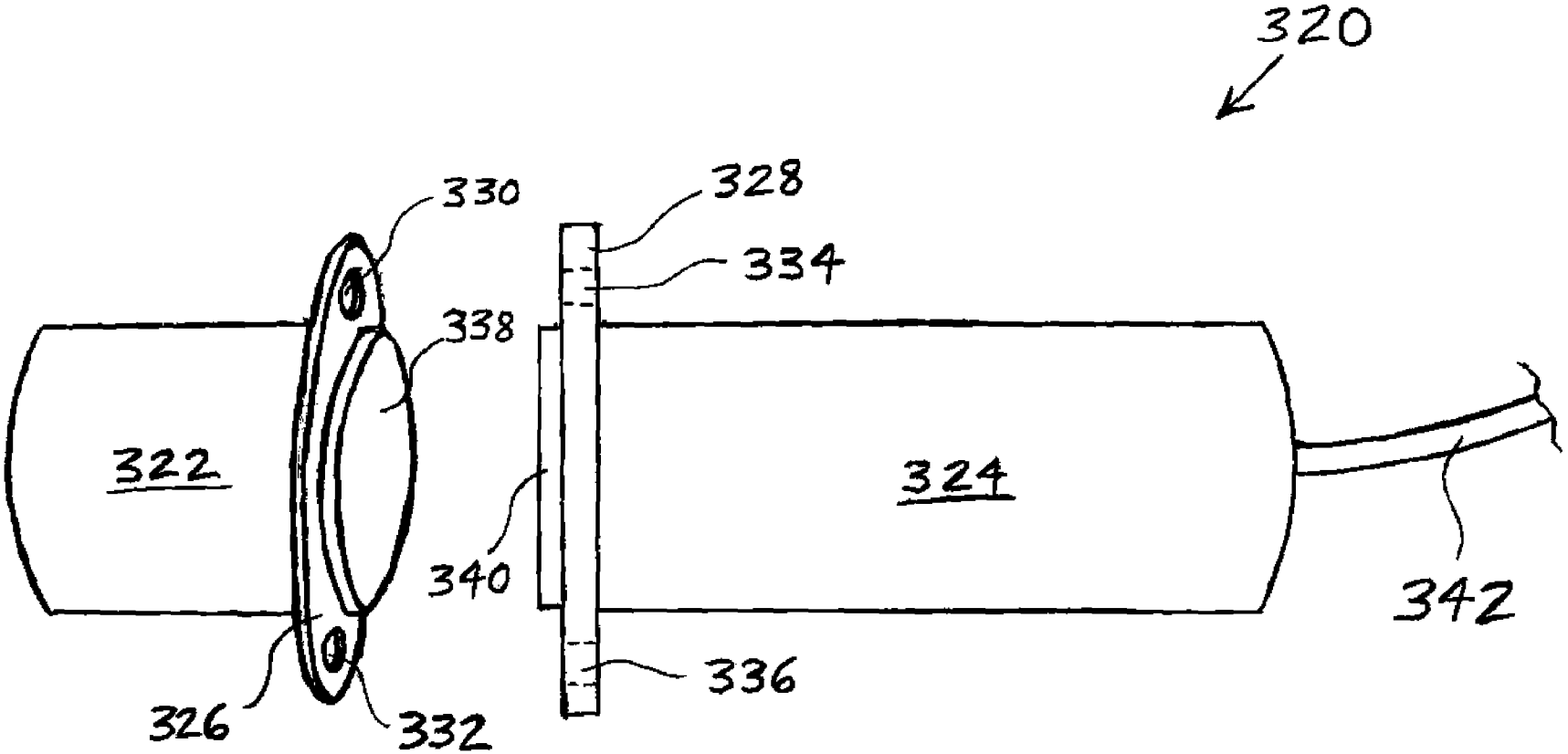
FIG. 10 is a perspective view of another embodiment of an optical security sensor apparatus of the present invention.

In FIG. 10 there is shown another embodiment of an optical security sensor apparatus 320 that is suitable for detecting movement of an object, such as a door or window, for example. Optical security sensor apparatus 320 includes a reflector arrangement 322 and an electronics arrangement in the form of a module 324. Reflector arrangement 322 and module 324 may be mounted in opposing locations within a door and a door frame, respectively, for example. Both reflector arrangement 322 and module 324 may have housings with circular cross sections for enhancing ease of manufacturing and ease of assembly. Reflector arrangement 322 and module 324 may have respective flanges 326, 328 for engaging the surfaces in which reflector arrangement 322 and module 324 are mounted. Flange 236 may have through-holes 330, 332, and flange 328 may have through-holes 334, 336 through which screws may be inserted for fastening reflector arrangement 322 and module 324 to their respective mounting surfaces. Reflector arrangement 322 may have a circular window 338, and module 324 may have a circular window 340. Both windows 338, 340 may be formed of a material that blocks visible light and passes infrared light. In one particular embodiment, windows 338, 340 are formed of Lexan® polycarbonate material. The electronics within module 324 may be electrically connected to a cable 342 that contains communication and power lines (not shown) that are connected to a control panel (not shown).

Figure 11:
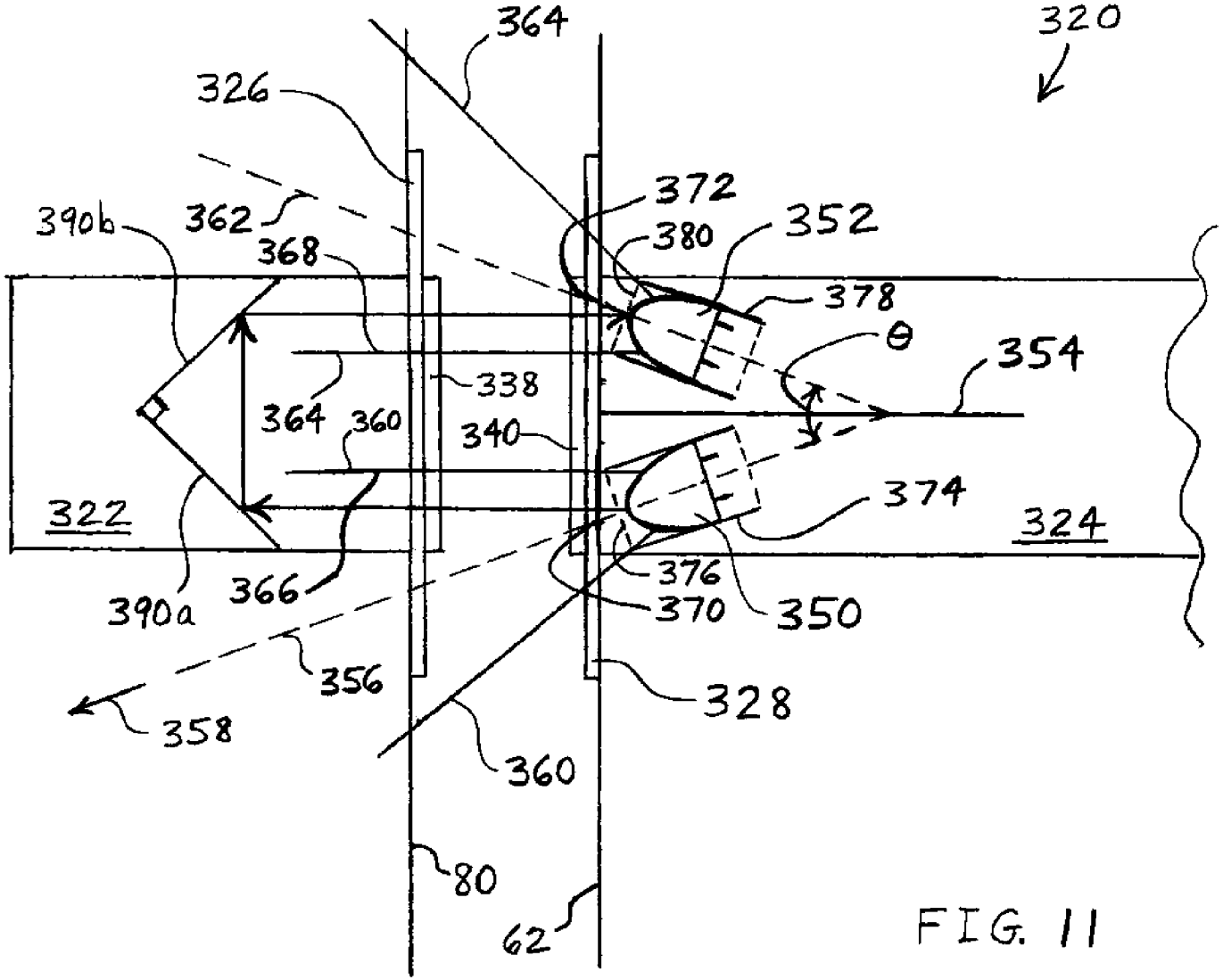
FIG. 11 is a schematic diagram of the sensor apparatus of FIG. 10.

As shown in FIG. 11, reflector arrangement 322 and module 324 may be mounted within surface 80 of perimeter 34 and surface 62 of door frame 16, respectively. Module 324 may include an optical emitter 350 and an optical receiver 352 that are directed generally away from each other in order to minimize the scattered or diffuse optical energy from emitter 350 that is received by receiver 352 without being reflected thereto by reflector arrangement 322. To further minimize such scattered or diffuse optical energy being received by receiver 352, module 324 may include an optical barrier 354 disposed between emitter 350 and receiver 352.

Emitter 350 may emit a beam of optical energy along an axis of emission 356 in an emission direction 358. Although the optical energy emitted by emitter 350 may be centered around axis 356, the optical energy may also be emitted in various directions clustered around axis 356. The optical energy emitted by emitter 350 may be confined to the space bounded by an imaginary emission cone 360 having a three-dimensional conical shape. As illustrated in FIG. 11, despite axis 356 not intersecting with a mirror 390*a* of reflector arrangement 322, a portion of the optical energy from emitter 350 may be reflected by mirror 390*a* toward mirror 390*b*. Mirror 390*b*, which may be oriented at a right angle to mirror 390*a*, may reflect the optical energy to receiver 352. Either or both of mirrors 390*a*, 390*b* may be planar. In one embodiment, cone 360 spans an angle of approximately between ten degrees and forty degrees.

Receiver 352 may be configured to most efficiently receive optical energy that is directed along an axis of reception 362. Although the optical energy received by receiver 352 may be centered around axis 362, the optical energy may also be received from various directions clustered around axis 362. The optical energy received by receiver 352 may be confined to the space bounded by an imaginary emission cone 364 having a three-dimensional conical shape. As illustrated in FIG. 11, despite axis 362 not intersecting with mirror 390*b* of reflector arrangement 322, a portion of the optical energy reflected by mirror 390*a* toward mirror 390*b* may be reflected by mirror 390*b* and received by receiver 352. In one embodiment, cone 364 spans an angle of approximately between ten degrees and forty degrees.

Axis of emission 356 may diverge in emission direction 358 from axis of reception 362 at an angle θ. In other words, emitter 350 may be pointed in a direction that is generally away from the direction in which receiver 352 is pointed. This may have the advantage of decreasing the probability that optical energy from emitter 350 reaches receiver 352 without having been reflected by reflector arrangement 322. In one embodiment, angle θ is at least two degrees. Angle θ may be such that emission cone 360 and reception cone 364 are nonintersecting. In a particular embodiment, respective adjacent edges 366, 368 of cones 360, 364 are substantially parallel to each other.

In addition to the divergence between axes 356, 362, there may be a substantially offset between axes 356, 362, which may further decrease the probability that optical energy from emitter 350 reaches receiver 352 without having been reflected by reflector arrangement 322. In one embodiment, a first point of intersection 370 between axis of emission 356 and surface 62 is separated by at least one inch from a second point of intersection 372 between axis of reception 362 and surface 62.

Emission cone 360 and reception cone 364 may be defined by some internal characteristics of emitter 350 and receiver 352, respectively. Alternatively, emission cone 360 may be defined both by the output characteristics of emitter 350 and by an optically opaque, annular tube or boot 374 disposed in association with emitter 350 and in which emitter 350 may be disposed. Boot 374 may mask or block the emission of any optical energy that is not directed through an open end 376 of boot 374. That is, boot 374 may block extraneous noise energy emissions that are outside of the intended emission cone 360. Such noise might otherwise be received by receiver 352 and cause false readings. Moreover, reception cone 364 may be defined both by the performance characteristics of receiver 352 and by an optically opaque, annular tube or boot 378 disposed in association with receiver 352 and in which receiver 352 may be disposed. Boot 378 may mask or block the reception of any optical energy that is not directed through an open end 380 of boot 378. That is, boot 378 may block extraneous noise energy emissions that are outside of the intended reception cone 364. Such noise might otherwise be received by receiver 352 and cause false readings.

An advantage of the circular cross sections of reflector arrangement 322 and electronics arrangement 324 is that, although reflector arrangement 322 and electronics arrangement 324 may need to be rotationally aligned with each other, the rotational orientation of reflector arrangement 322 and electronics arrangement 324 within respective surfaces 80, 62 may be arbitrary. That is, the rotational orientation may be anywhere within a 360 degree range. Thus, installation of the security sensor apparatus is simplified.

Because emitter 350 and receiver 352 are directed generally away from each other at angle θ, it may not be necessary for the beam emitted from emitter 350 to be polarized. That is, even if the beam is not polarized, the relative orientation of emitter 350 and receiver 352 may prevent diffusely emitted or scattered optical energy from emitter 350 from reaching receiver 352 without being reflected thereto by reflector arrangement 322.

Exemplary embodiments of a reflector arrangement of the present invention mounted in a surface 80 of perimeter 34 of door 14 are illustrated in FIGS. 12*a-b*. In the first embodiment illustrated in FIG. 12*a*, reflector arrangement 322 is in the form of a light pipe. Emitted beam 66 may be channeled from a first end 382 of the light pipe to a second end 384 via a plurality of internal reflections within the light pipe. Reflected beam 68 may emanate from second end 384 as shown. The light pipe may be embodied by an optical fiber, for example.

In the embodiment of FIG. 12*b*, a reflector arrangement 422 is in the form of two planar mirrors 186*a*, 186*b*. Mirror 186*a* may be oriented at an angle of greater than forty-five degrees relative to emitted beam 66 to thereby produce an intermediate reflected beam 67 that is oriented at an angle of greater than forty-five degrees relative to mirror 186*a* and at an angle of less than ninety degrees relative to emitted beam 66. Similarly, mirror 186*b* may be oriented at an angle of greater than forty-five degrees relative to intermediate reflected beam 67 to thereby produce a final reflected beam 68 that is oriented at an angle of greater than forty-five degrees relative to mirror 186*b*. Of course, the orientations of mirrors 186*a*, 186*b* depends upon the orientation of emitted beam 66 and the desired orientation of reflected beam 68.

Figure 13:
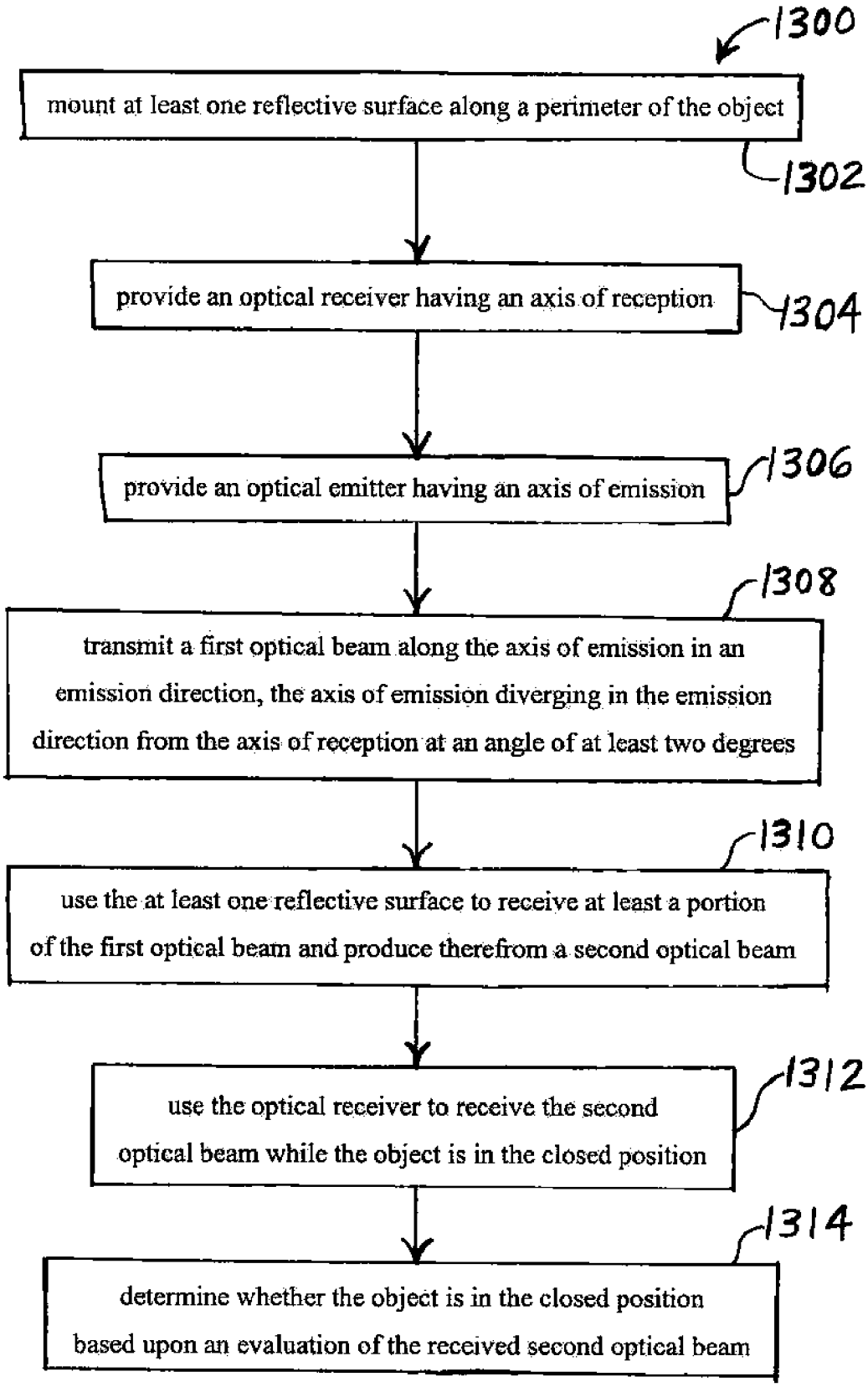
FIG. 13 is a flow chart of one embodiment of a method of the present invention for determining whether an object is in a closed position.

FIG. 13 illustrates one embodiment of a method 1300 of the present invention for determining whether an object is in a closed position. In a first step 1302, at least one reflective surface is mounted along a perimeter of the object. For example, any embodiment of a reflector arrangement disclosed herein includes at least one reflective surface and may be mounted along a perimeter 34 of door 14. In a next step 1304, an optical receiver having an axis of reception is provided. In particular, optical receiver 352 having an axis of reception 362 may be provided. An optical emitter having an axis of emission is provided in step 1306. For example, an emitter 350 having an axis of emission 356 may be provided. In step 1308, a first optical beam is transmitted along the axis of emission in an emission direction, the axis of emission diverging in the emission direction from the axis of reception at an angle of at least two degrees. For example, an optical beam may be transmitted along axis of emission 356 in an emission direction 358. Axis of emission 356 may diverge in emission direction 358 from axis of reception 362 at an angle θ of at least two degrees. In step 1310, the at least one reflective surface is used to receive the first optical beam and produce therefrom a second optical beam. For example, the at least one reflective surface of reflector arrangement 22 may receive originally emitted beam 44 and produce therefrom a final reflected beam 46. In a next step 1312, the second optical beam is received by the optical receiver while the door is in the closed position. That is, reflector arrangement 22 may be disposed opposite from electronics module 24 while door 14 is closed, and likewise receiver 52 may be in position to receive a final reflected beam 46 that may be produced by reflector arrangement 22 while door 14 is in the closed position. In a final step 1314, it is determined whether the door is in the closed position based upon an evaluation of the received second optical beam. In a particular example, controller 48 may evaluate an optical beam to be received by receiver 52. That is, controller 48 may ascertain whether receiver 52 is receiving and sensing an optical beam of any type. Further, if receiver 52 is indeed receiving and sensing an optical beam, controller 48 may ascertain whether the received optical beam carries a signal that has an expected relationship to a signal that may be carried by originally emitted beam 44. For example, controller 48 may expect the signal carried by reflected beam 46 to be substantially equivalent to the signal carried by emitted beam 44. As an alternative example, controller 48 may expect the signal carried by reflected beam 46 to have a certain drop in amplitude or a certain phase shift as compared to the signal carried by emitted beam 44. If it is found that the received optical beam does indeed carry a signal that has an expected relationship to a signal that is carried by originally emitted beam 44, then controller 48 may conclude that door 14 is in the closed position.

The present invention has been primarily described herein in connection with sensing the opening of a hinged door that swings between an open position and a closed position. However, it is to be understood that the features of the present invention described herein may be equally applicable to sensing the opening of any movable building structure (such as a window or a sliding door) that translates between an open position and a closed position. Further, the features of the present invention described herein may be applicable to sensing the movement of any object, including an object that is not part of a building.

The present invention has been described herein as including a reflector arrangement and an electronic module mounted at opposing locations within the door and the door frame, respectively. However, it is to be understood that it is within the scope of the present invention for the reflector arrangement to be mounted within the door frame and the electronic module to be mounted within the door. Moreover, it is also within the scope of the present invention for one of the reflector arrangement and the electronic module to be mounted within a bottom edge of the door and the other to be mounted at an opposing location within the floor surface.

The reflector arrangement of the present invention has been described herein as being mounted in an outer edge of a door so as to receive and reflect optical signals that are oriented parallel to a plane defined by the door. However, it is also possible for the reflector arrangement to be mounted within one of the two large opposite surfaces of the door, albeit along the perimeter of the door such that the reflector arrangement is covered, when the door is closed, by a portion of the door frame that is parallel to the plane defined by the door. In this way, the reflector arrangement would receive and reflect optical signals that are oriented perpendicular to a plane defined by the door.

The electronics module of the present invention has been described herein as being disposed in a fixed building structure, such as a door frame or a window frame. However, it is to be understood that it is also possible within the scope of the invention for both the electronics module and the reflector arrangement to be disposed in opposing surfaces of two movable structures. For example, the electronics module and the reflector arrangement may be disposed in opposing surfaces of a pair of French doors or a pair of French windows, both of which are hinged at opposite outside edges, and which open in the middle between the two movable structures.

While this invention has been described as having an exemplary design, the present invention may be further modified within the spirit and scope of this disclosure. This application is therefore intended to cover any variations, uses, or adaptations of the invention using its general principles.

What is claimed is:

1. A security sensor apparatus for sensing movement of an object, said sensor apparatus comprising:

an electronics arrangement including an optical emitter and an optical receiver, said optical receiver having an axis of reception, said optical emitter being configured to emit a first beam along an axis of emission in an emission direction, the axis of emission diverging in the emission direction from the axis of reception at an angle of at least two degrees, said emitter having an emission cone and said receiver having a reception cone, the emission cone and the reception cone being nonintersecting, said electronics arrangement being configured to be mounted in association with one of a first surface of the object and a second surface of a structure disposed in opposition to the first surface; and a reflector arrangement including at least one reflective surface, said reflector arrangement being configured to be mounted in association with an other of the first surface and the second surface, said at least one reflective surface being configured to receive an unreflected portion of the first beam and produce a second beam from the unreflected portion of the first beam, the second beam being directed at and received by said optical receiver.

2. The apparatus of claim 1 wherein an offset between a first point of intersection between the axis of emission and the one of a first surface of the object and a second surface of a structure is separated by at least one inch from a second point of intersection between the axis of reception and the one of a first surface of the object and a second surface of a structure.

3. The apparatus of claim 1 wherein the axis of emission diverges in the emission direction from the axis of reception at an angle of at least five degrees.

4. The apparatus of claim 1 wherein the axis of emission diverges in the emission direction from the axis of reception at an angle of at least ten degrees.

5. The apparatus of claim 1 wherein the axis of emission diverges in the emission direction from the axis of reception at an angle of at least twenty degrees.

6. The apparatus of claim 1 wherein the axis of emission diverges in the emission direction from the axis of reception at an angle of at least thirty degrees.

7. The apparatus of claim 1, further comprising means for determining whether the object is in a closed position based upon an evaluation of the received second beam.

8. A method of determining whether an object is in a closed position, said method comprising the steps of:

mounting at least one reflective surface along a perimeter of the object;

providing an optical receiver having an axis of reception;

providing an optical emitter having an axis of emission;

transmitting a first optical beam along the axis of emission in an emission direction, the axis of emission diverging in the emission direction from the axis of reception at an angle of at least two degrees;

using said at least one reflective surface to receive at least a portion of the first optical beam and produce therefrom a second optical beam;

using said optical receiver to receive the second optical beam while the object is in the closed position; and determining whether the object is in the closed position based upon an evaluation of the received second optical beam.

9. The method of claim 8 wherein the first optical beam carries a first signal and the second optical beam carries a second signal, said determining step being dependent upon both the first signal and the second signal.

10. The method of claim 8 wherein the axis of emission diverges in the emission direction from the axis of reception at an angle of at least five degrees.

11. The method of claim 8 wherein the axis of emission diverges in the emission direction from the axis of reception at an angle of at least ten degrees.

12. The method of claim 8 wherein the axis of emission diverges in the emission direction from the axis of reception at an angle of at least twenty degrees.

13. The method of claim 8, wherein said determining step includes determining whether the object is in the closed position based upon whether the second optical beam is sensed.

14. The method of claim 8 wherein the axis of emission diverges in the emission direction from the axis of reception at an angle of at least thirty degrees.

15. The method of claim 8 wherein the at least one reflective surface comprises two reflective surfaces, the two reflective surfaces being oriented at an angle of less than eighty-five degrees relative to each other.

16. A method of determining whether an object is in a closed position, said method comprising the steps of:

mounting at least one reflective surface along a perimeter of the object;

providing an optical receiver having an axis of reception;

providing an optical emitter having an axis of emission;

transmitting a first optical beam along the axis of emission in an emission direction, the axis of emission diverging in the emission direction from the axis of reception at an angle of at least two degrees, said emitter having an emission cone and said receiver having a reception cone, the emission cone and the reception cone being nonintersecting, adjacent edges of the emission cone and the reception cone being substantially parallel;

using said at least one reflective surface to receive at least a portion of the first optical beam and produce therefrom a second optical beam;

using said optical receiver to receive the second optical beam while the object is in the closed position; and determining whether the object is in the closed position based upon an evaluation of the received second optical beam.

17. The method of claim 16 wherein the first optical beam carries a first signal and the second optical beam carries a second signal, said determining step being dependent upon both the first signal and the second signal.

18. The method of claim 16 wherein the axis of emission diverges in the emission direction from the axis of reception at an angle of at least four degrees.

19. The method of claim 16 wherein the axis of emission diverges in the emission direction from the axis of reception at an angle of at least fifteen degrees.

20. The method of claim 16, wherein said determining step includes determining whether the object is in the closed position based upon whether the second optical beam is sensed.

* * * * *